US006131773A

United States Patent [19]

Wade et al.

[11] Patent Number: 6,131,773

[45] Date of Patent: Oct. 17, 2000

[54] MOUNTING AND LOCKING MECHANISM FOR A SOAP DISPENSER

[75] Inventors: Allan E. Wade, Manchester, Mo.; Keith D. Alsberg; James E. deBeers, both of Chicago, Ill.

[73] Assignee: Steris Inc, Temecula, Calif.

[21] Appl. No.: 09/236,954

[22] Filed: Jan. 25, 1999

Related U.S. Application Data

[60] Provisional application No. 60/114,229, Dec. 30, 1998.

[51] Int. Cl.[7] ..... B67D 5/32

[52] U.S. Cl. ..... 222/153.02; 222/153.09; 222/181.3; 222/214

[58] Field of Search ..... 222/214, 181.3, 222/325, 153.09, 153.02, 153.04

[56] References Cited

U.S. PATENT DOCUMENTS

| | | | |
|---|---|---|---|
| 3,540,630 | 11/1970 | Brown et al. . | |
| 4,164,306 | 8/1979 | Perrin . | |
| 4,470,523 | 9/1984 | Spector . | |
| 4,582,227 | 4/1986 | Kanfer . | |
| 4,615,476 | 10/1986 | Hobbs et al. . | |
| 4,621,749 | 11/1986 | Kanfer . | |
| 4,651,902 | 3/1987 | Hobbs et al. . | |
| 4,667,854 | 5/1987 | McDermott et al. | 222/214 |
| 4,673,109 | 6/1987 | Cassia . | |
| 4,679,709 | 7/1987 | Poitras et al. . | |
| 4,741,461 | 5/1988 | Williamson et al. . | |
| 4,886,192 | 12/1989 | Cassia . | |
| 4,974,753 | 12/1990 | Tucker et al. . | |
| 5,248,066 | 9/1993 | Olson et al. | 222/214 |
| 5,265,772 | 11/1993 | Bartasevich et al. | 222/214 |
| 5,464,125 | 11/1995 | Daansen | 222/214 |
| 5,632,418 | 5/1997 | Brown . | |
| 5,862,956 | 1/1999 | Brandenburg et al. | 222/214 |

*Primary Examiner*—Andres Kashnikow
*Assistant Examiner*—Christopher S. Kim
*Attorney, Agent, or Firm*—Fay, Sharpe, Fagan, Minnich & McKee, LLP

[57] ABSTRACT

An antiseptic soap dispenser (A) is mounted to a wall by a secure mounting system (E). A latching and locking mechanism (D) inhibits tampering with the dispenser or theft of a replaceable soap reservoir (B), received within a dispenser housing (C). The housing includes a front cover (18) pivotally connected to a back plate (20). The mounting mechanism (E) removably mounts the back plate of the housing to a wall mounting plate (24), which is attached by screws or other fixing means to a wall or other suitable mounting surface. The back plate includes mounting tabs (172) which engage a corresponding releasable engagement portion (170) on the mounting plate to secure the housing to the mounting plate. A latch plate (60), is movably carried by the back plate. The latch plate provides the latching and locking mechanism (D) which releasably locks the housing in a manner which is not readily obvious to a casual observer, yet which avoids the need for a key. The latching and locking mechanism (D) secures the front cover to the back plate. The latch plate includes a plurality of latching hooks (80) which engage tabs (90) on an interior of the front cover. The latching hooks are moved downward, and out of engagement, by pressing upward on a push bar (78) mounted to a lower end of the latch plate. A locking plate (110), pivotally connected to the latch plate, provides an optional additional locking system when pivoted to a position in which downward motion of the latch plate is prevented.

20 Claims, 11 Drawing Sheets

MOUNTING AND LOCKING MECHANISM FOR A SOAP DISPENSER

This application claims the priority of U.S. Provisional Application Serial No. 60/114229, filed Dec. 30, 1998.

BACKGROUND OF THE INVENTION

The present invention relates to the dispensing arts. It finds particular application in conjunction with antiseptic soap dispensers for accurately dispensing discrete doses of soap, hand lotions, creams, and the like, into the palm of a user, and will be described with particular reference thereto. It should be appreciated, however, that the invention is also applicable to the dispensing of other fluid, viscous, and pasty materials, such as food products, where accurate dosage is desired.

Hand-operated dispensers are widely used for delivery of liquid soaps, hand lotions, creams, and the like. These are typically mounted on a wall and consist of a housing and a dispensing mechanism. The fluid is stored in a replaceable reservoir, such as a plastic container, within the housing and delivered, as needed, by actuating the dispensing mechanism. The soap-filled containers are transported by maintenance personnel to the site of the soap dispenser as needed to replace empty containers.

A wide variety of dispensing mechanisms have been developed for dispensing discrete doses of fluid. One type of dispenser employs a resiliently flexible dispensing tube or pathway which is compressed between two rigid members to deliver the fluid. U.S. Pat. No. 4,667,854, U.S. Pat. No. 4,178,975, and U.S. Pat. No. 5,377,871 disclose examples of roller-type dispensers.

Such soap dispensers are often positioned in unattended locations, such as wash rooms and laboratories. There is therefore a certain risk of tampering or theft of the contents or the dispenser. Moreover, in certain facilities, such as mental institutions and the like, there is a risk of injury to a user that may obtain unauthorized access to the contents of the dispenser.

Simple latching systems provide a degree of protection against tampering in that the mechanisms for opening the dispensers are not always immediately obvious. U.S. Pat. Nos. 4,164,306 and 4,741,461, for example, disclose latch mechanisms which hold a front cover of a housing on to the back plate. However, such latch mechanisms do not provide a high degree of security.

Typically, mounted dispensers that have attempted to provide greater security have employed a key actuated locking mechanism on the housing. U.S. Pat. No. 3,540,630 discloses a key actuated locking system for a dispenser. U.S. Pat. No. 5,632,418 discloses a tamper-resistant soap dispenser in which a plastic key is used to secure a container of soap to a wall-mounted back plate. Such key mounted dispensers require, of course, that the maintenance personnel carry keys for the dispensers. Often keys are lost or forgotten and the housing is left unlocked for ease of access by the maintenance personnel. There remains a need for a secure system of locking a container of soap within the housing which does not require a key or other separate actuation device to provide access to the housing.

To mount the dispenser to a wall, the back plate is conventionally attached to the wall with screws or other suitable fixing means. However, such fixing means do not provide for ease of removal of the housing for replacement or repair. It is therefore convenient to mount the dispenser housing to a wall mounting plate which is screwed to the wall. Without a secure system of mounting the dispenser housing to the wall plate, however, the dispenser housing, together with its contents, is subject to theft or tampering. A key-actuated locking system for the mounting plate would be prone to the same problems as arise with a key system for the housing. There remains a need for a secure mounting system for a dispenser which does not require a key to remove the housing from the mounting plate.

The present invention provides a new and improved mounting and locking system for an antiseptic soap dispenser which overcomes the above referenced problems and others.

SUMMARY OF THE INVENTION

In accordance with one aspect of the present invention, a dispenser for dispensing viscous material from a reservoir is provided. The dispenser includes a housing which encloses the reservoir. The housing includes a back plate, a front cover attached to the back plate, a dispensing system carried by the housing for dispensing fluid from the reservoir, and a latch plate moveably carried by the back plate for movement from an engaged position, in which the front cover is latched to the back plate, and a disengaged position, in which the cover is movable between a closed position and an open position.

In accordance with another aspect of the present invention, a system for releasably mounting a dispenser to a wall and selectively locking a reservoir of fluid within the dispenser is provided. The dispenser is one which includes a housing that supports the reservoir in a position for dispensing fluid. The housing includes a back plate and a cover attached to the back plate and movable between open and closed positions. The system includes a latch plate carried by the back plate, the latch plate being movable between a first, or at rest position in which the cover is latched to the back plate in the closed position, or about to be latched from the open position, and a second position in which the cover is moveable between the closed position and the open position. A mounting plate for affixing the dispenser to a wall includes a resiliently deflectable mounting hook for lockably engaging the back plate with the mounting plate.

In accordance with another aspect of the present invention, a method is provided for securing a replaceable vessel within a housing of the type which includes a back plate and a front cover which is connected to the back plate for movement between a closed position and an open position, in which the vessel is removable. The method includes latching the front cover to the back plate with a moveable latching member which is moveable between a first position, in which the front cover is latched to the back plate, and a second position, in which the cover is movable to the open position. The method further includes securing the latching member is in the first position with a locking system which is moveable from a locked position, in which the latch plate is locked in the first position, to an unlocked position in which the latch plate is moveable between the first and second positions.

In accordance with another aspect of the present invention, a method of replacing a reservoir in a secure dispenser housing designed to inhibit tampering is provided. The housing includes a front cover connected to a back plate for movement between a closed position and an open position. The method includes pressing on a wall of the housing to move a release tab from a locking position, in which a latch plate locks the cover of the housing to the back plate, to an unlocked position, in which the latch plate is moveable to a position in which the cover is moveable from the closed position to the open position. The method further includes continuing to press on the wall of the housing while moving the latch plate to the position in which the cover is moveable from a closed position to an open position, and moving the cover to the open position. Further, the method includes replacing the reservoir with a fresh reservoir.

One advantage of the present invention is that it enables a container to be secured within a dispenser housing without the requirement for a key.

Another advantage of the present invention is that it permits a dispenser housing to be securely mounted on a wall mounting plate.

Another advantage of the present invention is that it provides a user with the option of activating a second locking system for added security.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
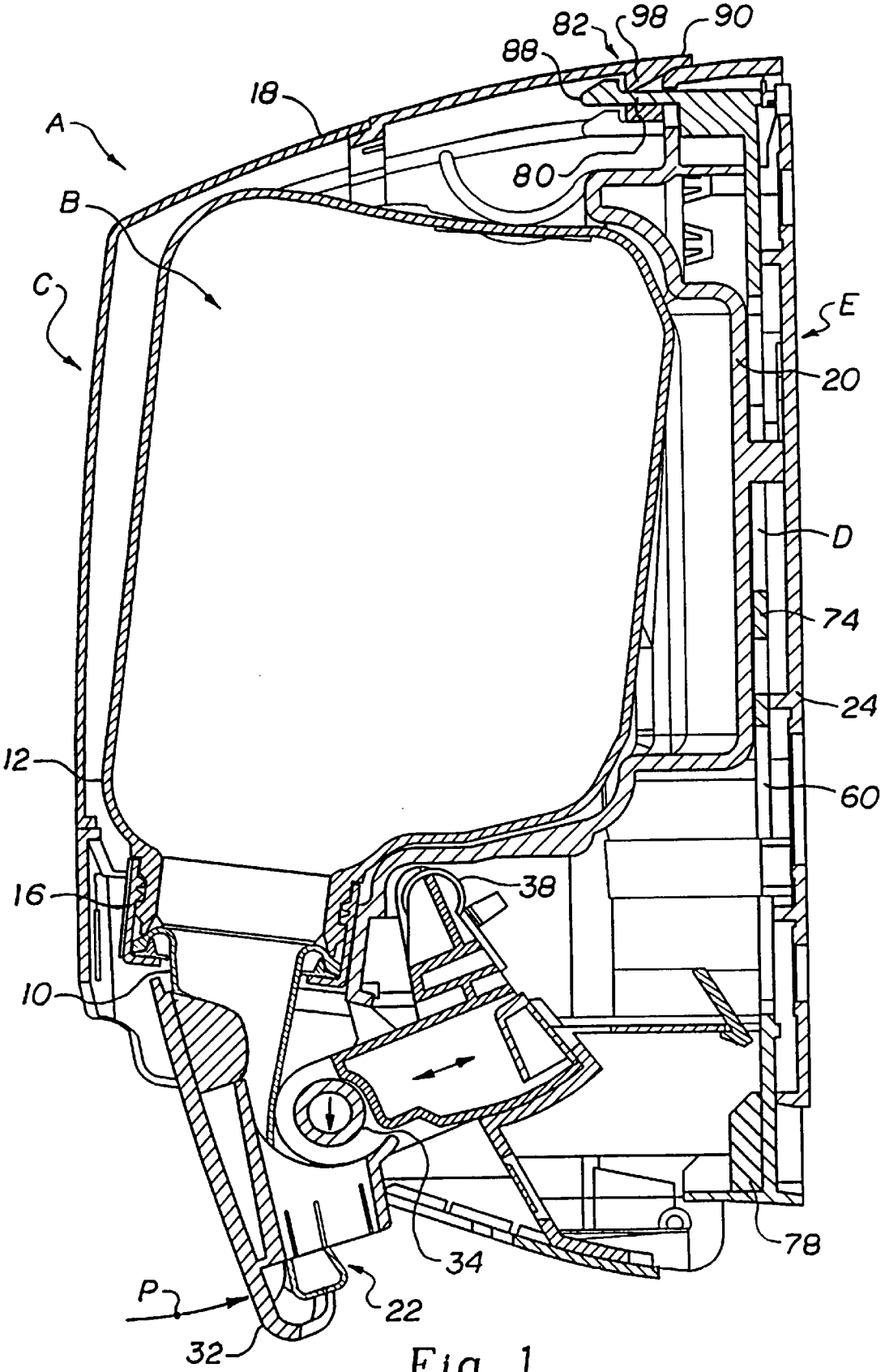
FIG. 1 is a side sectional view of a soap dispenser with the platen in a partially depressed position, according to the present invention.

With reference to FIG. 1, an antiseptic soap dispenser A includes a replaceable soap reservoir B, a housing C, a latching and locking mechanism D, and a wall mounting mechanism E. The reservoir B includes a dispensing tube or pathway 10 and a container 12 which holds an antiseptic soap or other fluid to be dispensed. The pathway 10 is attached to a neck 14 of the container by a cap 16, or other convenient means, providing a fluid flow path between an interior of the container 12 and the pathway. The housing C includes a front cover 18, which is pivotally connected to a back plate 20, and a dispensing system 22. The container 12 is supported within the housing C such that soap is delivered from the pathway 10 when the dispensing system 22 is actuated. The latching and locking mechanism D releasably locks the front cover 18 to the back plate 20. The wall mounting mechanism E removably mounts the housing to a wall mounting plate 24, which is attached by screws, adhesive, or other fixing means to a wall or other suitable mounting surface.

For ease of reference, the dispenser A is described with particular reference to the dispensing of cleaning fluids, such as antiseptic soaps. It should be appreciated, however, that the dispensing of other viscous fluids and pasty materials is also contemplated.

Figure 2:
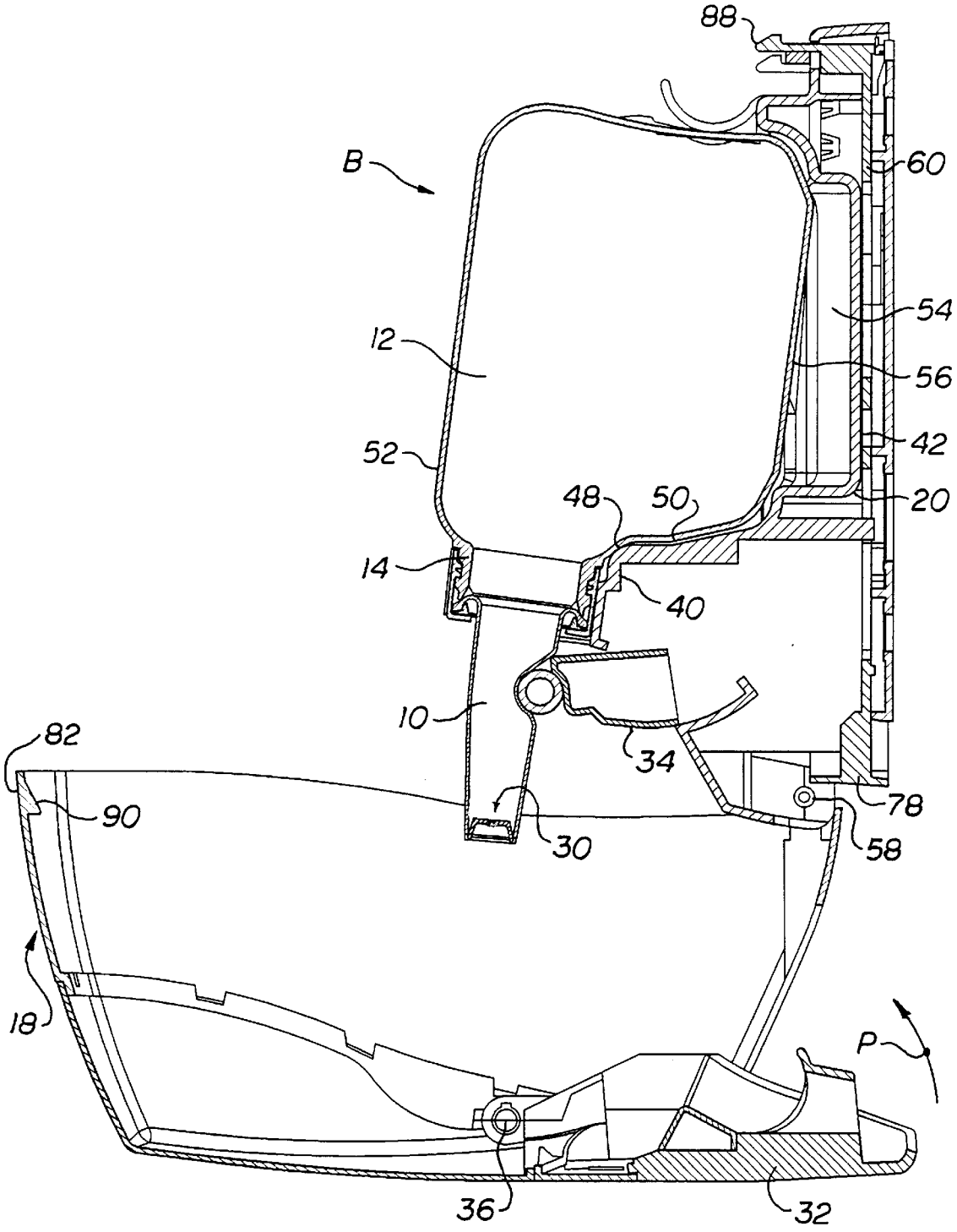
FIG. 2 is a side sectional view of the dispenser of FIG. 1 with the front cover open.

With continuing reference to FIG. 1 and further reference to FIG. 2, the dispensing system 22 causes the cleaning fluid to be ejected through a valve 30 at the dispensing end of the pathway 10. A preferred dispensing system includes a hand-actuated platen 32 and a movable roller assembly 34, although other dispensing systems are also contemplated. The plate pivots around a pivot point 36, on the front cover 18 of the dispenser housing, in the direction of arrow P. Pressure on the platen 32 compresses the pathway 10 between the platen and the roller assembly 34. As the platen is pressed further, the roller assembly cams downwards on the plate and travels down the compressed pathway, squeezing fluid through the valve 30 and drawing additional fluid from the container 12 into the pathway behind the roller assembly. When the pressure on the platen 32 is released, the resiliency of the pathway returns the platen to its original, at-rest position. Optionally, a spring (not shown) biases the platen to the at rest position. A biasing member, such as a return spring 38, biases the roller assembly 34 forward toward its at-rest position.

Figure 3:
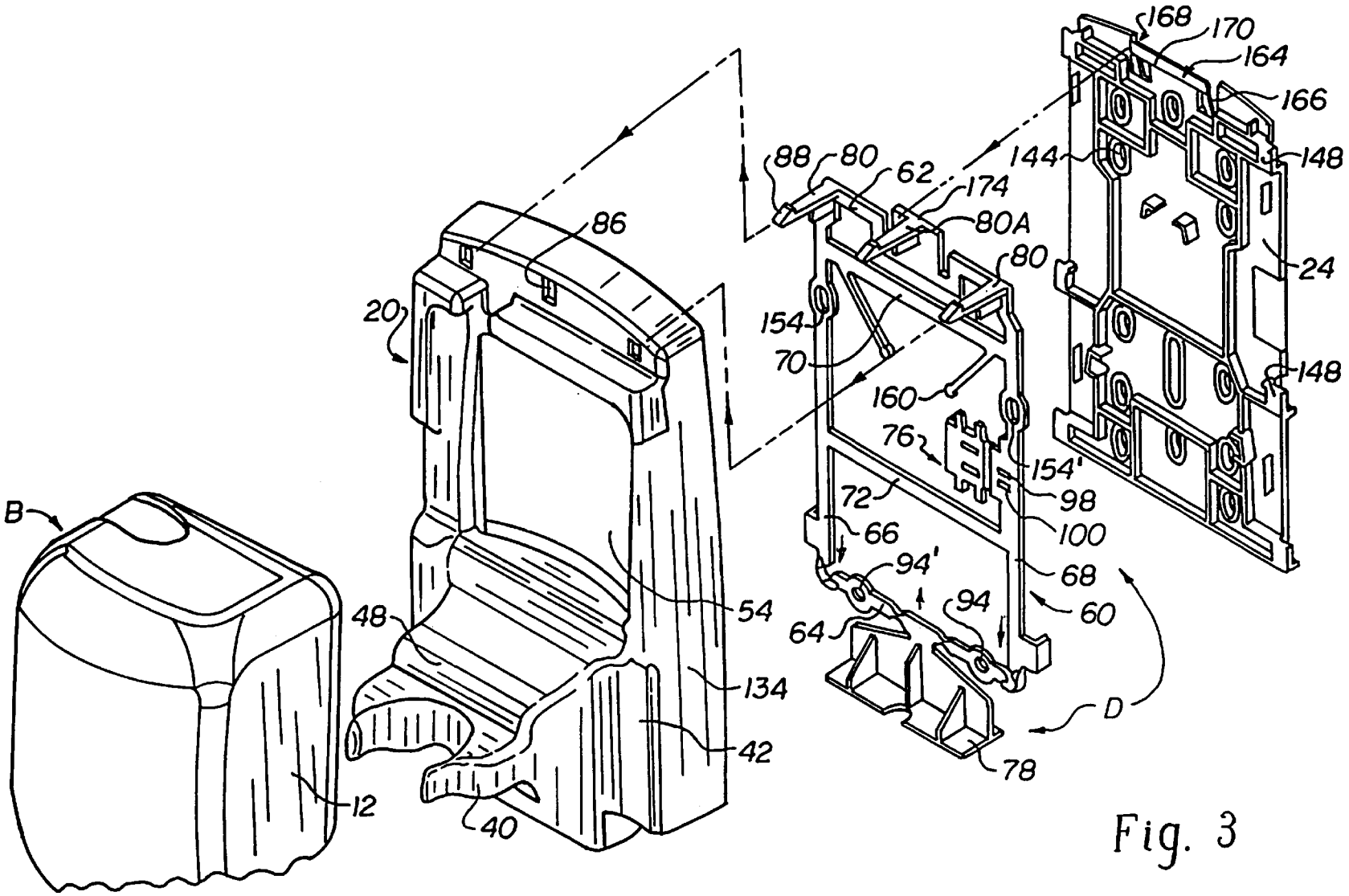
FIG. 3 is an exploded perspective view of the container, front cover, back plate, latch plate, and mounting plate of FIG. 1.

With continued reference to FIG. 2 and reference also to FIG. 3, the reservoir B is supported in the housing C by the back plate 20. In particular, a semicircular collar 40 extends forward from a vertically extending rear wall 42 of the back plate and receives the neck 14 of the container 12 therethrough. An upper surface of the collar defines an undulating shelf portion 48 which receives a similarly shaped lower portion 50 of an exterior wall 52 of the container 12. The rear wall 42 of the back plate defines a well 54 which receives a rear portion 56 of the container wall 52. The housing front cover 18 is pivotally connected at its lower end to a lower end of the back plate 20 at two laterally displaced pivot points 58, one positioned on each side of the back plate.

Figure 4:
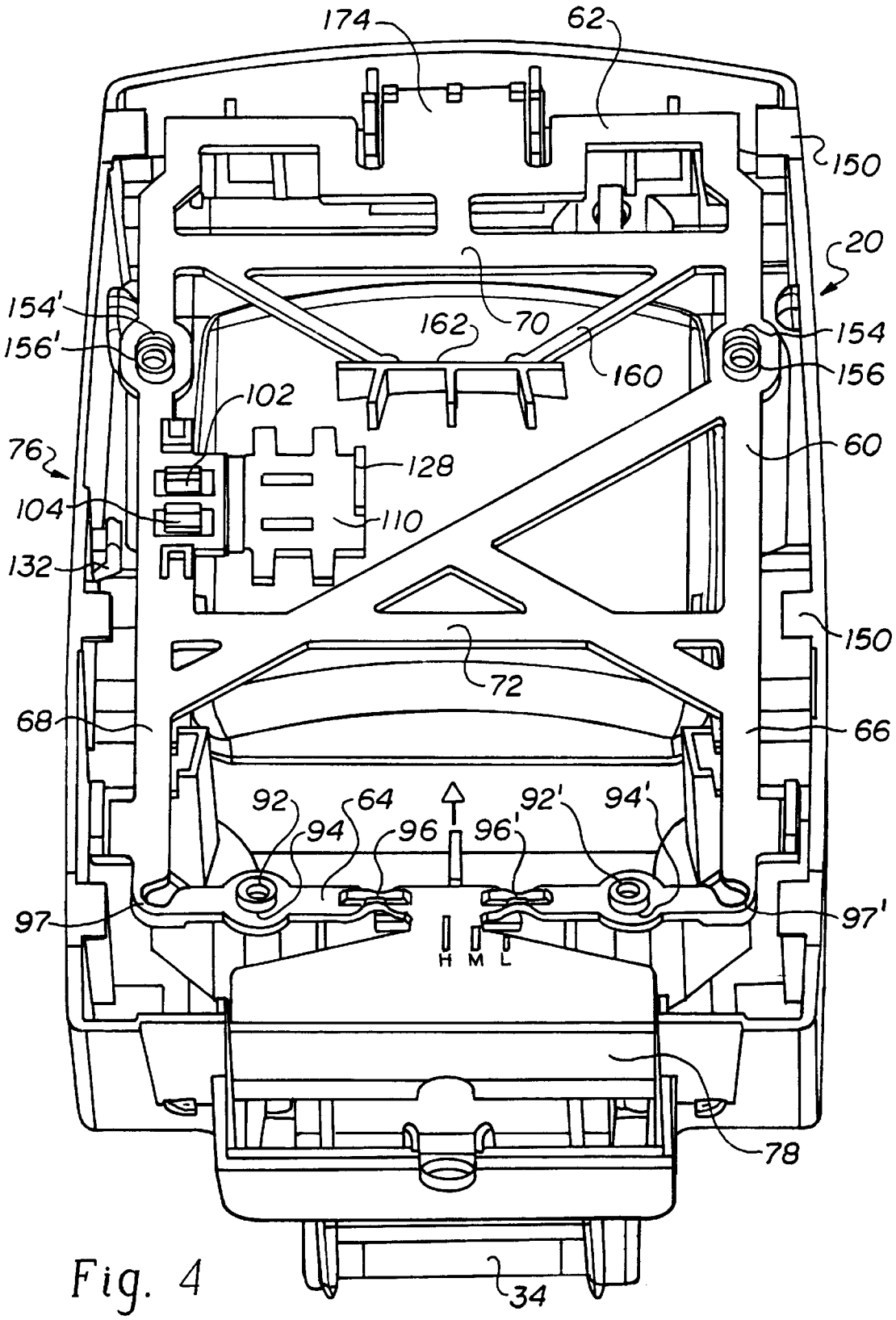
FIG. 4 is a rear perspective view of the back plate and latch plate of FIG. 1.

With continued reference to FIGS. 2 and 3, and reference also to FIG. 4, a latch plate 60, movably carried by the back plate 20, serves to latch the front cover 18 of the housing in the closed position and selectively release the front cover when the latching and locking mechanism D is disengaged. The latch plate also serves to release the back plate 20 from the wall mounting plating 24 when needed. The latch plate 60 is preferably formed of a resilient material, such as plastic. It may be molded as a single piece or formed by welding or other suitable means. The latch plate comprises upper and lower generally horizontal members 62 and 64, respectively, and vertical side members 66 and 68, respectively, which together define a generally rectangular frame. One or more intermediate bracing members 70 and 72 optionally provide rigidity to the frame.

The latching and locking mechanism D releasably locks the front cover 18 to the latch plate 60, preventing tampering with the reservoir 12, unless disengaged as described below. The latching and locking system D includes first and second systems 74 and 76, for latching and locking the front cover to the back plate, associated with the latch plate 60, which are not immediately obvious from the exterior of the dispenser, yet which permit the housing C to be unlocked with simple movements, without the need for a key.

The first, or latching system 74 includes a push bar 78, which extends vertically downward from the lower member 64 of the latch plate 60, and a number of laterally displaced latching hooks 80 which extend forward from the upper member 62 of the latch plate. As shown in FIG. 3, three latching hooks 80 are employed, although it is also contemplated that two, or more than three, latching hooks could be used. In the latched position, the latching hooks engage an upper wall 82 of front cover 18. The push bar 78 is pressed upward in order to release the upper wall 82 of the front cover from engagement with the latching hooks 80. Specifically, the rear wall 42 of the back plate 20 defines a series of laterally displaced, vertically extending apertures 86, adjacent an upper end thereof. The aperture are each positioned to receive a distal end 88 of one of the latching hooks therethrough. The distal ends 88 each define a flange or hook portion. When the front cover 18 is in a closed position, the latching hooks 80 protrude through the apertures 86 in the back plate and the distal ends engage tabs 90 on an interior surface of the upper wall 82. The apertures 86 have sufficient vertical length to allow the latching hooks 80 to move downwardly, and out of engagement with the tabs 90.

When the push bar 78 is pressed from below to release the front cover 18, the latch plate 60 pivots about pivot members, such as a pair of laterally displaced rigid pivot pins 92, 92', and an upper portion of the latch plate moves generally downward. Specifically, the pivot pins 92, 92' extend rearwardly from the rear wall 42 of the back plate. The pins are received through corresponding laterally displaced apertures 94, 94' defined in the lower horizontal member 64 of the latch plate. The lower member defines first and second pairs of laterally displaced thinned regions. The first pair of thinned regions 96, 96', is positioned with one thinned region on each side of the push bar 78, between a midpoint of the lower member and the respective apertures 94, 94'. The second pair of thinned regions 97, 97' is positioned at the meeting of the side members 66, 68 and the lower member 64. In cooperation, the thinned regions 96, 96', 97, 97' act as hinges to permit the latch plate to flex so that only a middle portion of the lower member 64 moves upward while the remainder of the latch plate, including side members 66, 68 and upper member 62 moves downward. As a result, the latching hooks 80 move downward and the flanges 88 at the ends of the latching hooks disengage from the tabs 90 on the front cover 18, thereby releasing the front cover. In such a disengaged, or unlatched position, the front cover may be pivoted downward to provide access to the interior of the housing C. To close the front cover 18 once more, the front cover is pivoted upward again until the tabs 90 engage the flanges 88. Camming surfaces 98, on the lower surfaces of the tabs, best shown in FIG. 8, cause the flanges, and the adjoining portions of the latch plate, to move downwardly sufficiently for the flanges to pass under the tabs and reengage with the tabs.

Figure 5:
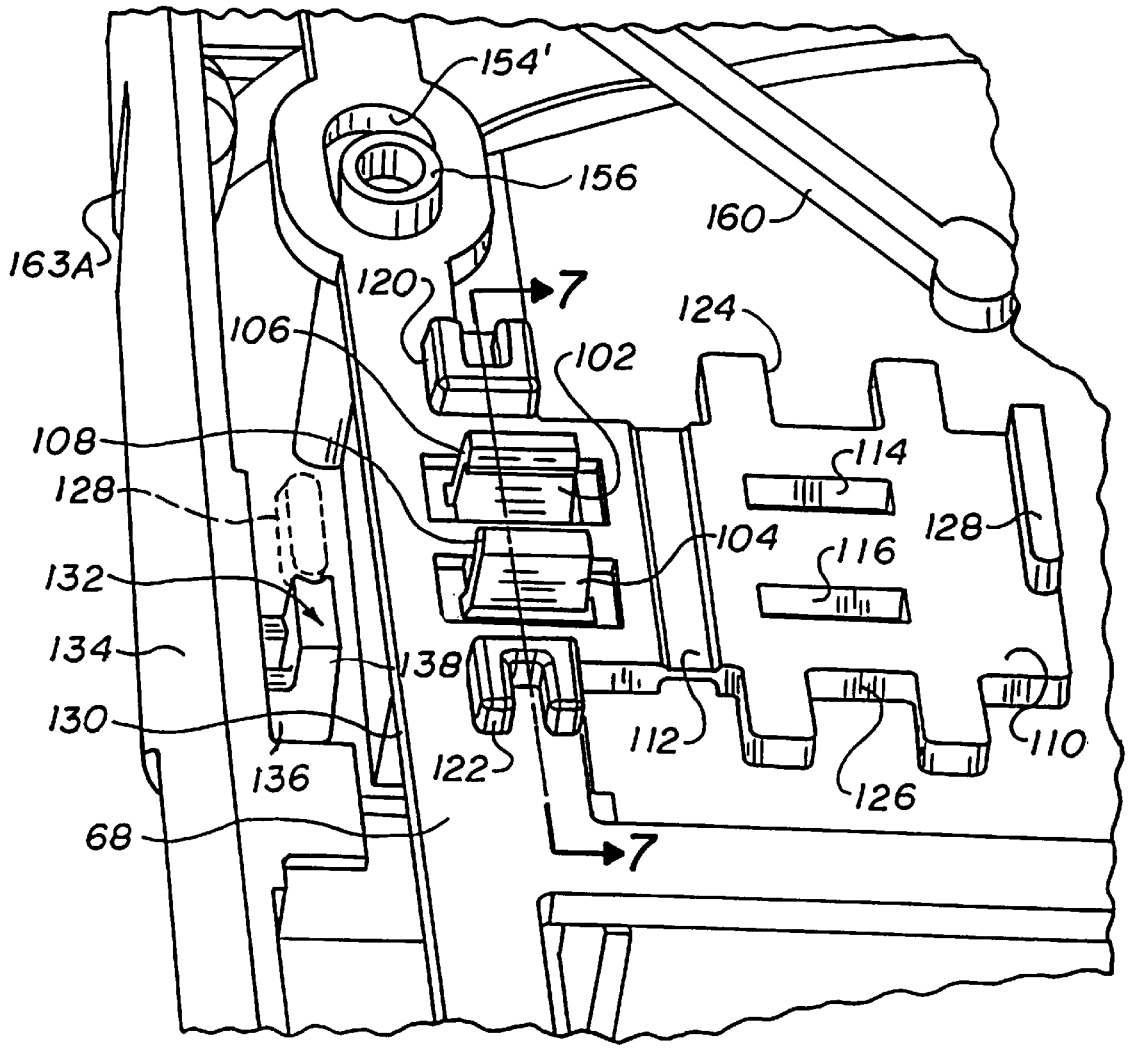
FIG. 5 is an enlarged rear perspective detail view of the locking system of FIG. 1 in the disengaged position.
Figure 6:
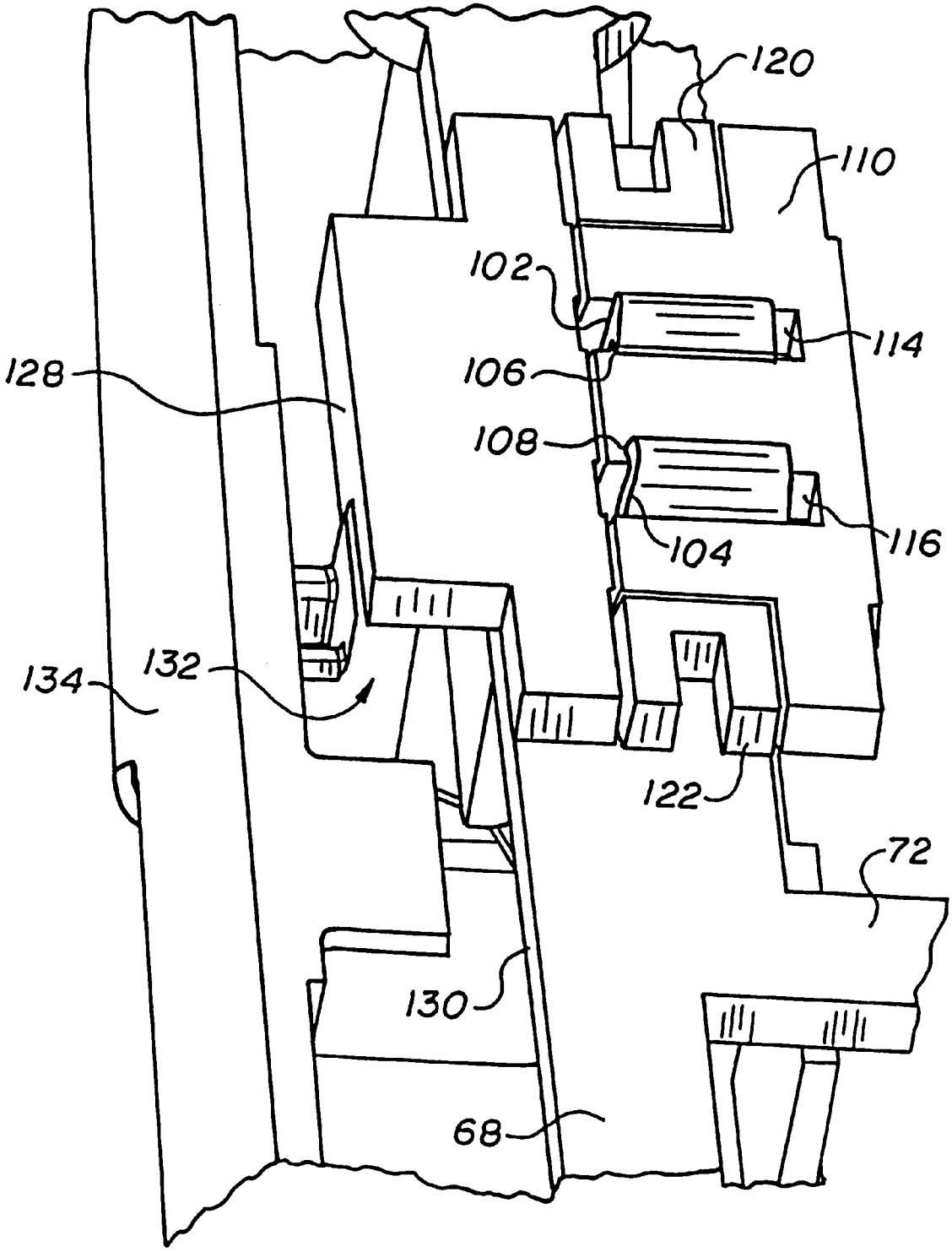
FIG. 6 is an enlarged perspective detail view of the locking system of FIG. 5 in the engaged position.
Figure 7:
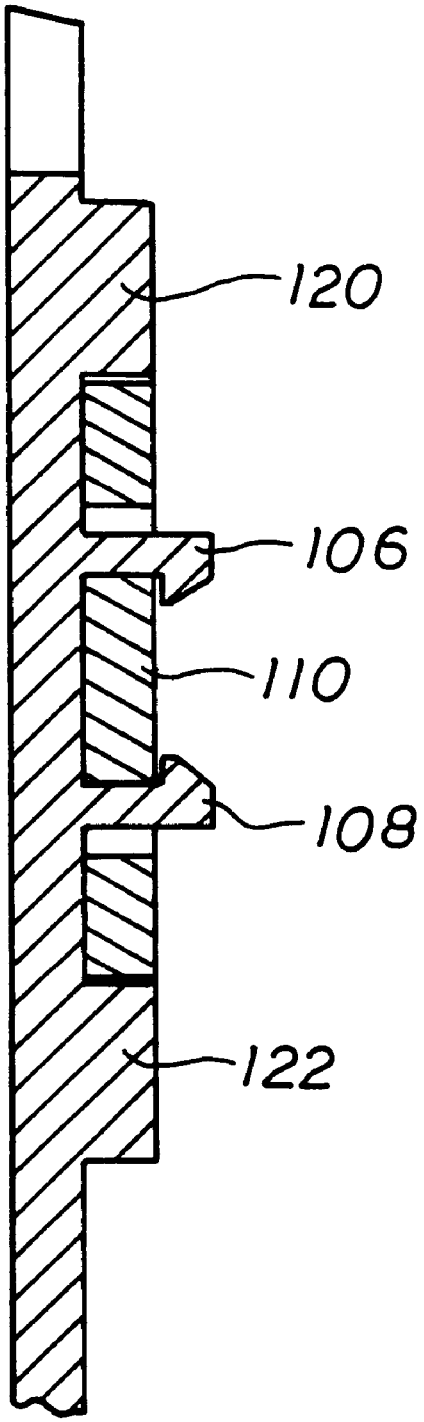
FIG. 7 is a side sectional view through section 7 of FIG. 5.

With continued reference to FIG. 4 and reference also to FIGS. 5–7, the second, locking system 76 provides an optional additional security feature. When activated, the locking system 76 prevents the latch plate 60 from being moved to the disengaged position unless the locking system is first disengaged. That is, a two step combination latch/lock is provided to limit access to those knowing the combination. As shown in FIG. 4, the locking system 76 is associated with the right-hand side member (viewed from the front). It should be appreciated, however, that the locking system is alternatively positioned on the left-hand side member. The locking system includes upper and lower resiliently flexible tangs 102 and 104, which extend rearwardly from the side member 68 of the latch plate. Distal ends of the upper and lower tangs define hooks 106 and 108 which face towards each other.

The locking system 76 also includes a locking plate 110 which is integrally formed with the side member 68. In a deactivated position, the locking plate extends laterally adjacent the tangs 102, 104. In the deactivated position, the latch plate 60 is free to move to the disengaged position, i.e., only the push bar 78 needs to be pressed to open the front panel. A hinge 112 is preferably formed by a thinned region between the locking plate 110 and the side member 68. The latch plate and locking plate can thus be formed from a single sheet of plastic.

The locking plate 110 includes a pair of vertically displaced aperture 114 and 116 which are sized to receive the tangs 102 and 104 snugly therethrough when the locking system 76 is activated, i.e., when a two step combination latch/lock is desired. To activate the locking system, the locking plate is pivoted around the hinge 112 until the apertures 114 and 116 are positioned over the respective tangs 102, 104 as shown in FIG. 6. The locking plate is held in position by engagement of the tang hooks 106, 108 with adjacent portions of the locking plate. Additionally, a pair of vertically displaced tabs 120 and 122, which extend rearwardly from the side member 68 engage upper and lower notches 124 and 126 defined in the locking plate to inhibit vertical movement of the locking plate relative to the side member 68. In the activated position thus described, an engagement tab 128 extends rearwardly from the locking plate 110 adjacent an outer edge 130 of the side member. A vertically aligned release tab 132 extends inwardly from an adjacent, resiliently flexible, vertically extending side wall 134 of the back plate 20. The release tab 132 includes a narrowed portion 136, connected with the side wall 134, and a rearwardly extending wider portion 138. Until disengaged, the release tab 132 is positioned such that the wider portion 138 is aligned with and directly beneath the engagement tab 128, thereby preventing the upper portion of the latch plate 60 from moving downward. The narrower portion 136 is displaced forwardly from the engagement tab 128, allowing the engagement tab to pass over the narrower portion when the two are vertically aligned.

To temporarily disengage the locking system 76, an operator presses on the side wall 134 of the back plate adjacent the locking system. The pressure moves the wider portion 138 of release tab 132 out of vertical alignment with the engagement tab 128. The push bar 78 can then be pushed upward to move the upper portion of the latch plate 60 downward and release the front cover 18. Continued pressure on the side wall is maintained while the push bar is being pressed upward, since once the pressure is released, the resiliency of the side wall allows it to flex outward again, bringing the engagement tab 128 and release tab wider portion 138 once more into vertical alignment. With the latching hooks 80 thereby disengaged, the front cover pivots downward around the pivot points 58, providing access to the container 12 and the pathway 10.

Once the upward pressure on the push bar 78 is released, the resiliency of the lower member 64 causes the upper portion of the latch plate 60 to move upward to its original, at-rest position. Once again, however, the front cover tabs 90 can be reengaged with the latching hooks 80 simply by moving the front cover to the closed position. The latching hooks have sufficient flexibility that they cam over the tabs 90 until the flanges engage the tabs.

The locking system 76 is activated at the discretion of the installer. For convenience, the system is preferably installed on all dispensers but is inoperative until the locking plate 110 is pivoted to the activated position. The locking system thus provides an additional security measure when it is deemed necessary, for example, where there is a high risk of tampering or theft. It is activated, if at all, before the housing C is mounted to the wall mounting plate 24. Once activated, it can be subsequently deactivated by first dismounting the housing from the mounting plate, as described hereinafter, and then prying the locking plate 110 out of engagement with the tang hooks 106, 108.

With reference once more to FIG. 3, the wall mounting plate 24 mounts the dispenser to a wall or other suitable surface. Preferably, the mounting plate is configured for attachment to a variety of different wall surfaces or to pre-existing mounting systems. The mounting plate is attached to the wall using screws or other suitable relatively permanent fixing means. The wall mounting plate 24 defines openings 144 for receiving the screws. The back plate 20 is removably supported on the mounting plate by a number of L-shaped flanges 148 which extend forwardly from the mounting plate. The flanges receive corresponding projections 150 which extend rearwardly from the rear wall 42 of the back plate. To position the back plate on the mounting plate, the latch plate 60 is positioned rearwardly of the back plate and the latch hooks 80 are inserted into the apertures 86. The back plate and latch plate are lowered vertically downwards until the back plate projections 150 are received within the L-shaped flanges 148. If the locking system 76 is to employed, the locking plate 110 is pivoted into the engaged position before lowering the back plate into position.

The latch plate 60 thus it received between the back plate 20 and the wall mounting plate 24. The latch plate is connected to the back plate for limited vertical movement of the latch plate. In addition to the pivot pins 92,92' and corresponding apertures 94,94' elongate openings 154, 154' defined in the side members 66, 68 of the latch plate receive tubular projections 156, 156' therethrough which extend rearwardly from the back plate. Preferably the distal ends of the tubular projections 156, 156' and pivot pins 92,92' are swaged or provided with acorn nuts, or the like (not show) to lock the latch plate 60 to the back plate 20. Other fixing means for attaching the latch plate to the back plate are also contemplated. The vertical length of the elongate openings 154, 154' defines the range of travel of the latch plate relative to the back plate. Additionally, two resiliently flexible flexing members 160 assist in positioning the latch plate. These extend diagonally downward from a bracing member 70 of the latch plate. Distal ends of the flexing members are engaged by an adjacent upper surface of a horizontal engagement member 162 which extends rearwardly from the rear wall 42 of the back plate. The flexing members flex as the push bar 78 is pressed and the latch plate is moved from the at rest position. Once pressure on the push bar is released, the flexing members assist in returning the latch plate to its original position.

Figure 8:
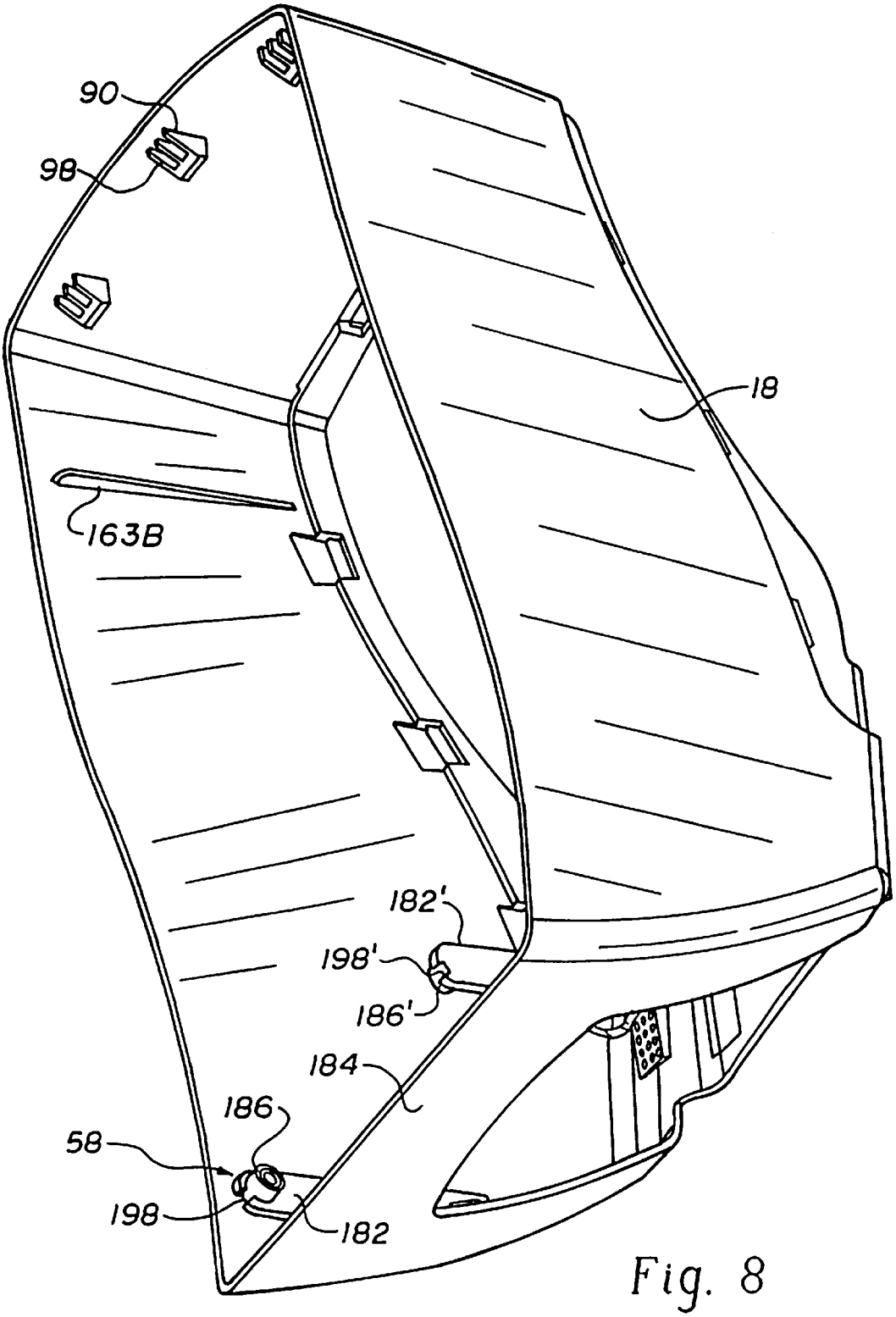
FIG. 8 is a rear perspective view of the front cover of the dispenser of FIG. 1.
Figure 9:
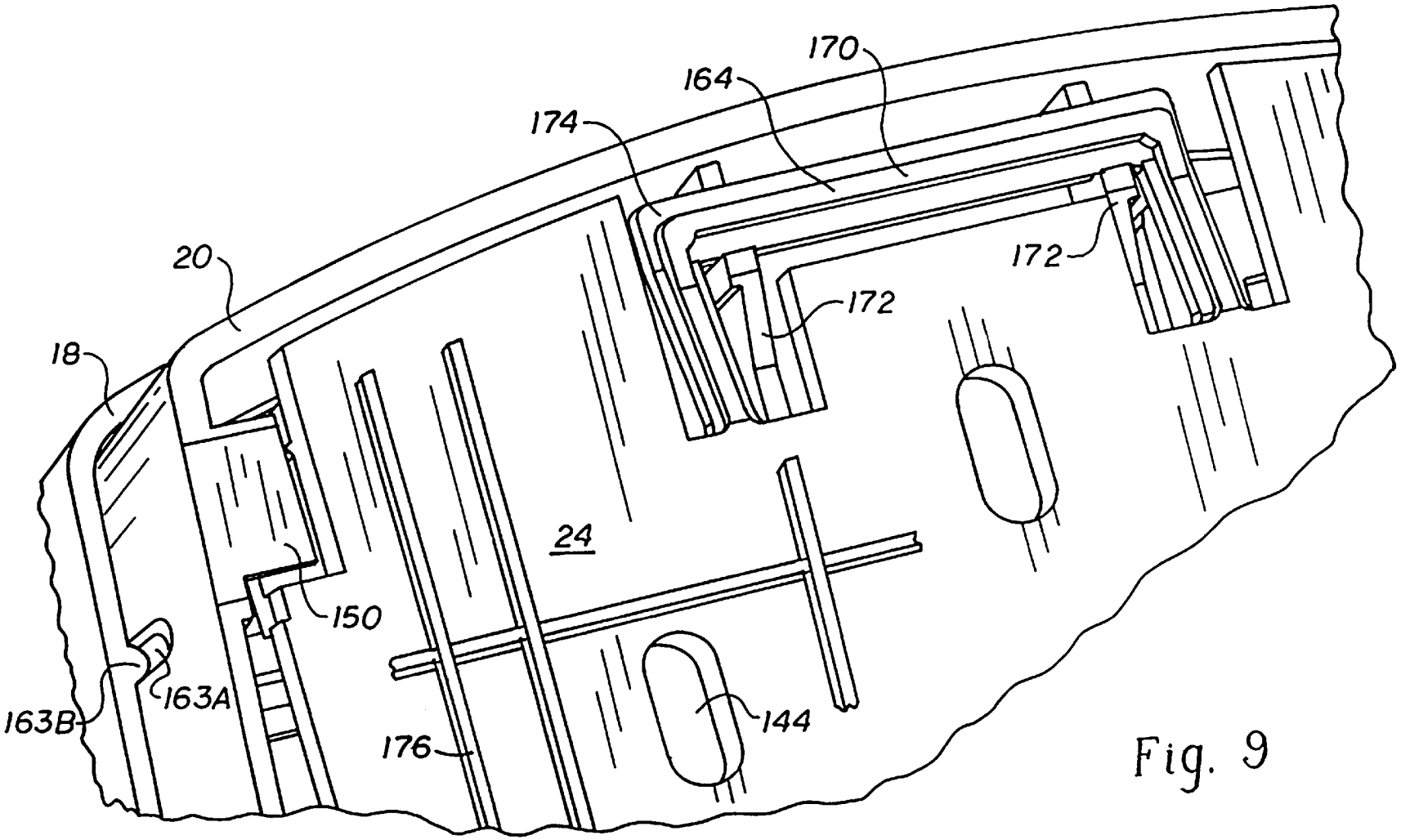
FIG. 9 is an enlarged rear perspective view of the dispenser of FIG. 1, showing the mounting plate locked to the back plate.

With reference to FIGS. 8 and 9, a horizontal groove 163A is defined in an exterior surface of the side wall 134 of the back plate to minimize relative vertical movement between the back plate 20 and the front cover. When the front cover 18 is engaged with the latching hooks 80, a corresponding horizontal rib 163B on an interior surface of the cover (best shown in FIG. 8) engages the groove 163A, as shown in FIG. 9. This engagement assists in preventing unauthorized access to the dispenser which could otherwise result if an upward pressure were placed on the front cover while a downward pressure was placed on the back plate until the front cover was unlatched from the latching hooks. Preferably a pair of ribs are used, one on either side of the cover, and a pair of corresponding grooves, one on either side of the backplate.

Of course, the positions of the groove 163A and the rib 163B could be reversed, with the groove being defined on the interior surface of the front cover and the and the rib being defined on the exterior surface of the side wall of the back plate.

With reference once more to FIG. 3, the back plate 20 is releasably attached to the wall mounting plate 24 by an upper mounting hook 164 which extends upward and diagonally forward from an upper end of the mounting plate. The hook 164 includes resiliently flexible arms 166 which allow the hook to be depressed into a recess or opening 168 in an adjacent portion of the mounting plate. To attach the back plate to the mounting plate, the mounting hook 164 is depressed into the recess 168 while latch plate 60 and back plate 20 are slid vertically downward from above. The upper mounting hook springs outward when the latch plate is fully installed. The hook 164 includes a forward extending engagement portion 170. The engagement portion engages corresponding barbs or mounting tabs 172 which extend vertically from the rear face of the back plate 20, as shown in FIG. 9. Once the back plate is in position, the tabs 172 inhibit removal of the back plate without careful depression of the mounting hook 164. This is readily achieved by rearward depression of the central latching hook 80A (shown in FIG. 3), which protrudes through one of the apertures 86 in the back plate. The central latching hook is attached to a resiliently flexible portion 174 of the upper member 62 of the latch plate. When the central latching hook is depressed, the flexible portion 174 is pushed rearwardly. The flexible portion in turn moves the mounting hook rearwardly, and out of engagement with the barbs 172. This method of removal of the back plate is not immediately obvious when the dispenser is fully installed.

On the back of the mounting plate are multiple score lines 176 which can be selectively removed for adjusting to different deformities of the wall.

Figure 10:
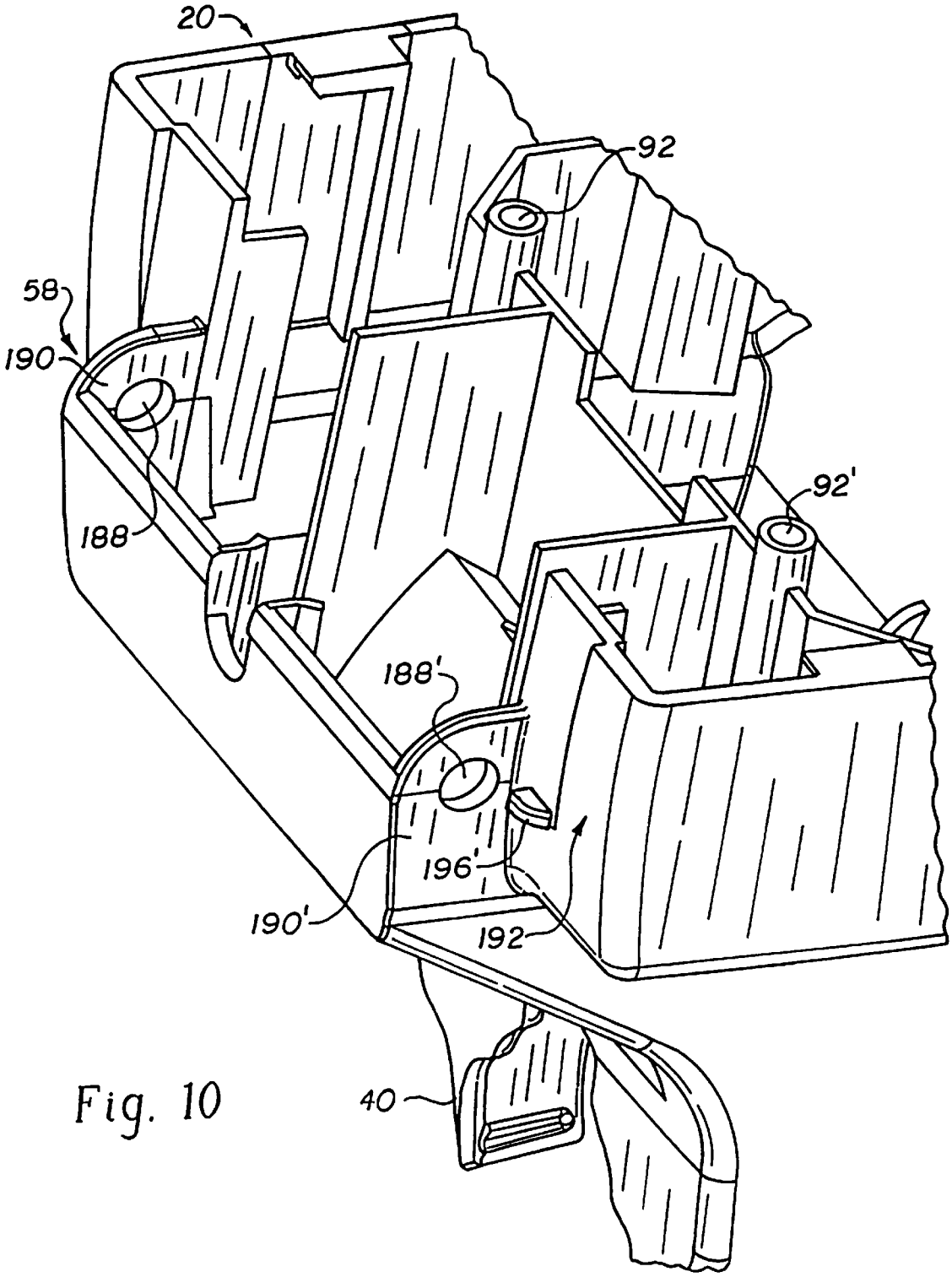
FIG. 10 is an enlarged rear perspective view of the back plate of FIG. 1; and, FIG. 11 is an enlarged front perspective view of the front cover pivotally connected to the base of the back plate of FIG. 1.
Figure 11:
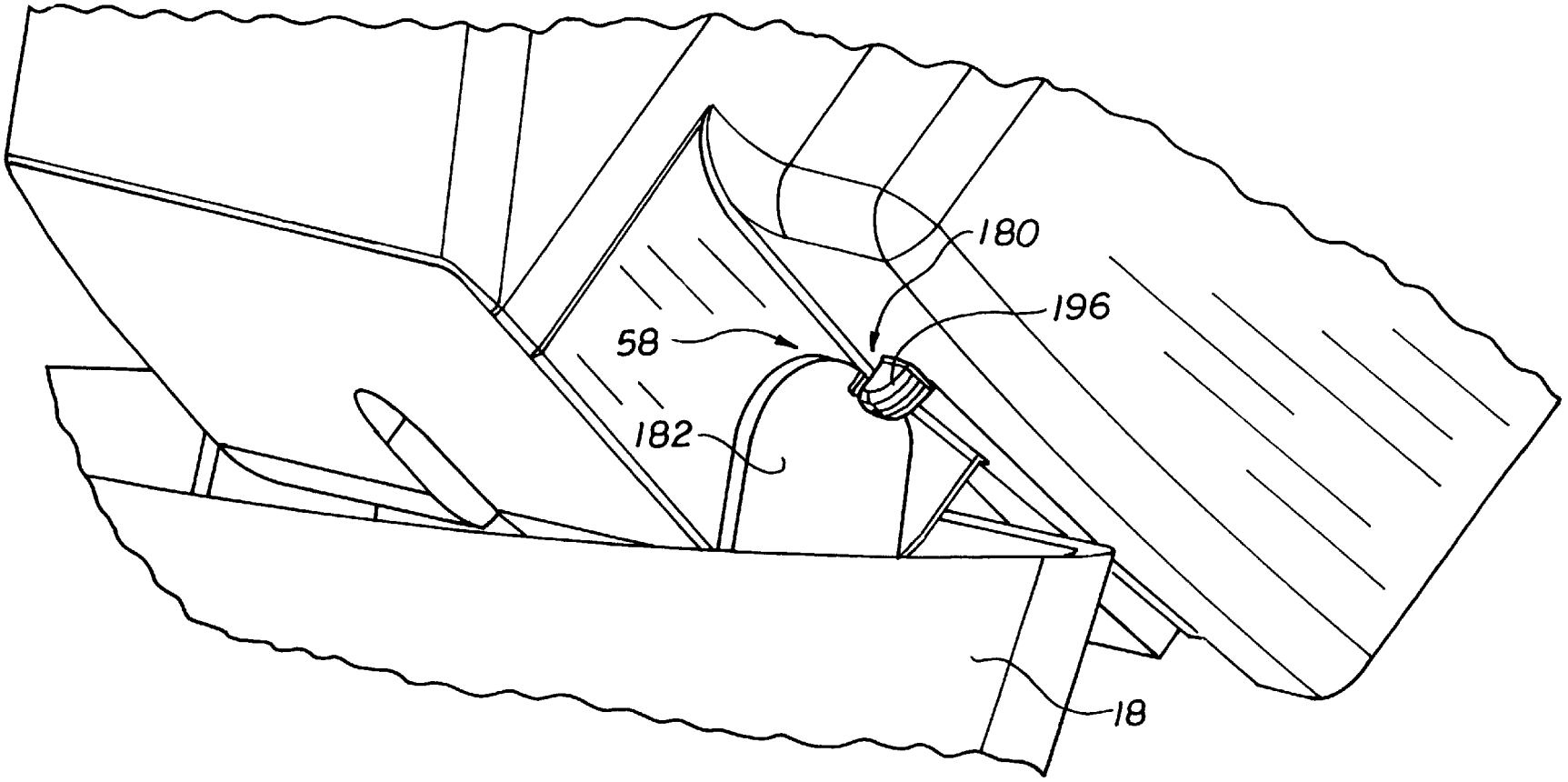

With reference once more to FIG. 8, and reference also to FIGS. 10 and 11, the front cover 18 is pivotally connected to the back plate 20 at pivot points 58. A key system 180 prevents the cover from being removed from the back plate other than in the position shown in FIG. 11. In this position, the front cover is fully away from and extends slightly rearward of the back plate. This configuration of front cover and back plate is not possible once the dispenser has been mounted to a wall or other mounting surface, thus inhibiting removal of the front cover from the dispenser once the dispenser has been installed on a wall.

Two laterally spaced flanges 182 and 182' extend rearwardly from a lower surface 184 of the front cover 18. A pair of opposed pivot pins 186 and 186' extend inwardly from the flanges. The pivot pins are received through a corresponding pair of laterally spaced openings 188 and 188' which are defined in walls 190 and 190' which extend vertically from a lower surface 192 of the back plate 20. The key system 180 includes a pair of keys 196 and 196', one for each pivot point 58, which extend from the lower surface 192 of the back plate adjacent the corresponding apertures 188 and 188'. Each of the flanges 182 and 182' includes a corresponding notch 198, 198' at a distal end of the flange, adjacent the pivot pins 186 and 186', respectively. When the front cover and back plate are brought together in the flanges engage the corresponding keys 196 and 196' and the pivot pins slot into the corresponding apertures 188 and 188'. When the front cover is pivoted towards the closed position, the keys engage unnotched portions of the flanges, preventing removal of the pivot pins from the apertures and thereby maintaining the connection between the front cover and the back plate. Accordingly, the front cover is connected to the back plate prior to installing the dispenser on a wall, or other surface.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A dispenser for dispensing viscous material from a reservoir, comprising:

a housing which encloses the reservoir, the housing including:

a back plate;

a front cover attached to the back plate;

a dispensing system carried by the housing for dispensing fluid from the reservoir;

a latch plate moveably carried by the back plate for movement from an engaged position, in which the front cover is latched to the back plate, to a disengaged position, in which the cover is movable between a closed position and an open position; and a release tab, movable by pressure on a wall of the housing from a locking position, in which the latch plate locks the cover of the housing to the back plate, to an unlocked position, in which the latch plate is moveable to the disengaged position.

2. A dispenser for dispensing viscous material from a reservoir, comprising:

a housing which encloses the reservoir, the housing including:

a back plate, and a front cover attached to the back plate;

a dispensing system carried by the housing for dispensing fluid from the reservoir; and a latch plate moveably carried by the back plate for movement between an engaged position, in which the front cover is latched to the back plate, and a disengaged position, in which the cover is movable between a closed position and an open position, the latch plate including:

a plurality of hooks which engage tabs on an interior of the front cover when the latch plate is in the engaged position, and a push bar, an upward position on the push bar moving the hooks downward and out of latching engagement with the front cover.

3. The dispenser of claim 2, wherein the latch plate is pivotally connected to the back plate in two pivot points either side of the push bar, such that an upward pressure on the push bar pivots portions of the latch plate about the pivot points, causing the hooks to move downward.

4. The dispenser of claim 3, wherein the pivot points include pivot pins which extend rearward from the back plate and the latch plate includes:

apertures in a lower member of the latch plate which receive the pivot pins therethrough; and, flexible regions which allow the latch plate is pivot around the pivot pins.

5. The dispenser of claim 2, wherein one of the front cover and the back plate includes a groove which engages a rib on the other of the front cover and the backplate which together limit vertical movement of the front cover relative to the backplate once the front cover is latched to the backplate.

6. A dispenser for dispensing viscous material from a reservoir, comprising:

a housing which encloses the reservoir, the housing including:

a back plate, and a front cover attached to the back plate;

a dispensing system carried by the housing for dispensing fluid from the reservoir;

a latch plate moveable carried by the back plate for movement between an engaged position, in which the front cover is latched to the back plate, and a disengaged position, in which the cover is movable between a closed position and an open position; and a locking system which selectively prevents movement of the latch plate between the engaged position and the disengaged position.

7. The dispenser of claim 6, wherein the locking system includes a locking plate which is movable from a first position, in which the locking system does not prevent movement of the latch plate and a second position, in which the locking system is moveable from a locking position, in which the movement of the latch plate is prevented, to an unlocked position, in which the latch plate is moveable between the engaged position and the disengaged position.

8. The dispenser of claim 7, wherein the locking plate is hingedly connected to the latch plate for pivoting the locking plate between the first position and the second position.

9. The dispenser of claim 7, further including at least one tang extending rearwardly of the latch plate, the locking plate including an aperture for receiving the tang therethrough, the tang defining an engagement surface for engaging the locking plate.

10. The dispenser of claim 6, wherein the locking system includes:

a first tab mounted on the latch plate; and a second tab mounted on the back plate, the second tab moveable between a locked position, in which the second tab engages the first tab, and an unlocked position in which the second tab is disengaged from the first tab and the latch plate is moveable to the disengaged position.

11. The dispenser of claim 10, wherein the back plate includes a flexible portion adjacent the second tab, whereby a pressure on the flexible portion moves the second tab to the unlocked position.

12. The dispenser of claim 10, wherein the first and second tabs are vertically aligned in the locked position.

13. A dispenser for dispensing viscous material from a reservoir, comprising:

a housing which encloses the reservoir, the housing including:

a back plate including a mounting tab; and a front cover attached to the back plate;

a dispensing system carried by the housing for dispensing fluid from the reservoir;

a latch plate moveable carried by the back plate for movement from an engaged position, in which the front cover is latched to the back plate, and a disengaged position, in which the cover is movable between a closed position and an open position; and a mounting plate for affixing the dispenser to a wall, the mounting plate including a resiliently flexible mounting hook for selectively engaging the back plate.

14. A dispenser for dispensing viscous material from a reservoir, comprising:

a housing which encloses the reservoir, the housing including:

a back plate, and a front cover, pivotally connected to the backplate;

a dispensing system carried by the housing for dispensing fluid from the reservoir;

a latch plate moveable carried by the back plate for movement from an engaged position, in which the front cover is latched to the back plate, and a disengaged position, in which the cover is movable between a closed position and an open position; and a key system connected with the back plate and the front cover which prevents removal of the front cover from the back plate once the dispenser is mounted on a mounting surface.

15. A system for releasably mounting a dispenser to a wall and selectively locking a reservoir of fluid within the dispenser, the dispenser being of the type which includes a housing which supports the reservoir in a position for dispensing fluid, the housing including a back plate and a cover attached to the back plate and movable between open and closed positions, the system including:

a latch plate carried by the back plate, the latch plate being movable between a first position in which the cover is latched to the back plate in the closed position, and a second position in which the cover is movable between the closed position and the open position;

a mounting plate for affixing the dispenser to a wall, the mounting plate including a resiliently deflectable mounting hook for lockably engaging the back plate with the mounting plate.

16. A method for securing a replaceable vessel within a housing of the type which includes a back plate and a front cover which is connected to the back plate for movement between a closed position and an open position, in which the vessel is removable, the method comprising:

latching the front cover to the back plate with a moveable latching member which is moveable between a first position, in which the front cover is latched to the back plate, and a second position, in which the cover is moveable to the open position; and, securing the latching member in the first position with a locking system which is moveable from a locked position, in which the latch plate is locked in the first position, to an unlocked position in which the latch plate is moveable between the first and second positions.

17. The method of claim 16, wherein the locking system is moveable between the locked and the unlocked positions by applying an inward pressure to an adjacent portion of the housing.

18. A method of replacing a reservoir in a secure dispenser housing designed to inhibit tampering, the housing including a front cover connected to a back plate for movement between a closed position and an open position, the method comprising:

pressing on a wall of the housing to move a release tab from a locking position, in which a latch plate locks the cover of the housing to the back plate, to an unlocked position, in which the latch plate is moveable to a position in which the cover is moveable from the closed position to the open position;

continuing to press on the wall of the housing while moving the latch plate to the position in which the cover is moveable from the closed position to the open position;

moving the cover from the closed position to the open position; and replacing the reservoir with a fresh reservoir.

19. The method of claim 18, wherein the release tab engages a vertically aligned engagement tab on the latch plate when the release tab is in the locking position and the step of pressing on a wall of the housing includes moving the release tab out of engagement with the engagement tab.

20. The method of claim 18, further including after the step of replacing the reservoir with a fresh reservoir:

moving the front cover from the open position to the closed position so that the latch plate latches the front cover the back plate.

* * * * *